US010139115B2

(12) United States Patent
Lackie et al.

(10) Patent No.: US 10,139,115 B2
(45) Date of Patent: Nov. 27, 2018

(54) AIR HANDLING UNIT WITH INNER WALL SPACE

(75) Inventors: Scott A. Lackie, Tyler, TX (US); William Randall Erwin, Tyler, TX (US)

(73) Assignee: Trane International Inc., Piscataway, NJ (US)

( * ) Notice: Subject to any disclaimer, the term of this patent is extended or adjusted under 35 U.S.C. 154(b) by 745 days.

(21) Appl. No.: 12/732,762

(22) Filed: Mar. 26, 2010

(65) Prior Publication Data

US 2011/0232860 A1 Sep. 29, 2011

(51) Int. Cl.

| | |
|---|---|
| ***H05K 7/20*** | (2006.01) |
| ***F24F 3/044*** | (2006.01) |
| ***F24F 13/20*** | (2006.01) |

(52) U.S. Cl.

CPC ..... *F24F 3/0442* (2013.01); *F24F 13/20* (2013.01); *F24F 2013/207* (2013.01)

(58) Field of Classification Search

CPC .. B65D 90/02; H05K 5/00; H05K 7/20; F24F 13/20; F24F 13/04

USPC ..... 454/184, 237, 238, 248, 229

See application file for complete search history.

(56) References Cited

U.S. PATENT DOCUMENTS

| | | | | |
|---|---|---|---|---|
| 1,796,828 A | | 3/1931 | Clingman | |
| 2,789,024 A | | 4/1957 | Heisler | |
| 2,893,220 A | * | 7/1959 | Blum | F24F 5/001 62/404 |
| 3,212,285 A | | 10/1965 | Wilson | |
| 3,623,335 A | | 11/1971 | Shanner | |
| 4,415,019 A | | 11/1983 | Huzicker | |
| 4,426,120 A | * | 1/1984 | Johnson | F24F 3/0442 206/321 |
| 4,723,419 A | | 2/1988 | Kessler et al. | |
| 4,825,847 A | | 5/1989 | Perron | |
| 4,972,298 A | | 11/1990 | Casa et al. | |
| 5,160,481 A | | 11/1992 | Weaver | |

(Continued)

FOREIGN PATENT DOCUMENTS

| | | |
|---|---|---|
| CN | 2226126 A | 5/1996 |
| CN | 2226126 Y | 5/1996 |

(Continued)

OTHER PUBLICATIONS

Stewart, Jeffrey L., et al.; U.S. Appl. No. 12/732,772, filed Mar. 26, 2010; "Air Handling Unit With Inner Wall Features;".

(Continued)

*Primary Examiner* — Steven B McAllister
*Assistant Examiner* — Samantha Probst
(74) *Attorney, Agent, or Firm* — Conley Rose, P.C.; J. Robert Brown, Jr.

(57) ABSTRACT

An air handling unit has an interior shell, an exterior skin associated with the interior shell to form a wall space at least partially bound by each of the interior shell and the exterior skin, and a control component at least partially carried within the wall space. A cabinet for an air handling unit has at least one wall comprising an interior shell and an exterior skin associated with the interior shell to form a wall space at least partially bound by each of the interior shell and the exterior skin. The at least one wall at least partially defines a fluid duct of the cabinet and a control component is at least partially disposed within the wall space.

12 Claims, 13 Drawing Sheets

(56) References Cited

U.S. PATENT DOCUMENTS 5,170,550 A 12/1992 Cox et al.
5,255,969 A * 10/1993 Cox ..... F24F 13/20 312/236
5,271,455 A * 12/1993 Semple ..... H02B 1/56 165/80.4
5,277,036 A 1/1994 Dieckmann et al.
5,301,744 A * 4/1994 Derks ..... F24F 13/20 165/137
5,396,782 A 3/1995 Ley et al.
5,450,285 A * 9/1995 Schlemmer ..... A47B 91/00 248/615
5,485,878 A * 1/1996 Derks ..... F24F 3/044 165/137
5,485,954 A 1/1996 Guy et al.
5,517,387 A * 5/1996 Smith ..... G06F 1/1616 361/679.32
5,582,026 A 12/1996 Barto, Sr.
5,622,058 A 4/1997 Ramakrishnan et al.
5,825,847 A 10/1998 Ruth et al.
5,897,181 A 4/1999 Avendano et al.
5,992,960 A 11/1999 Wolanin
6,065,296 A 5/2000 Feger
6,065,531 A 5/2000 Schneider et al.
6,076,370 A 6/2000 Da Silva
6,082,441 A * 7/2000 Boehmer ..... H02B 1/56 165/129
6,088,225 A * 7/2000 Parry et al. ..... 361/704
6,155,070 A * 12/2000 Rust, Jr. ..... F24F 1/0007 49/501
6,170,562 B1 * 1/2001 Knoblauch ..... F28D 9/00 165/104.33
6,311,735 B1 * 11/2001 Small, Sr. ..... F16L 9/003 138/109
6,409,591 B1 6/2002 Sullivan et al.
6,598,668 B1 * 7/2003 Cosley ..... H05K 7/206 165/104.32
6,637,232 B1 10/2003 Harshberger et al.
6,658,904 B2 12/2003 Herbeck et al.
6,676,234 B2 1/2004 Herbeck et al.
6,781,831 B1 * 8/2004 Banton et al. ..... 361/690
6,788,544 B1 9/2004 Barsun et al.
6,807,056 B2 * 10/2004 Kondo et al. ..... 361/689
6,879,486 B1 * 4/2005 Banton et al. ..... 361/690
6,974,383 B2 12/2005 Lewis et al.
6,987,673 B1 * 1/2006 French et al. ..... 361/727
7,036,333 B2 5/2006 Schurig et al.
7,108,478 B2 9/2006 Hancock
7,187,547 B1 * 3/2007 French et al. ..... 361/679.33
7,227,754 B2 * 6/2007 Griesinger ..... H01F 27/10 310/64
7,244,390 B2 7/2007 Bates et al.
7,286,356 B2 * 10/2007 Keenan et al. ..... 361/700
7,312,993 B2 * 12/2007 Bundza ..... H05K 7/206 165/104.33
7,457,112 B2 * 11/2008 Fukuda ..... G11B 33/022 361/679.48
7,489,509 B2 * 2/2009 Keenan et al. ..... 361/700
7,598,461 B2 * 10/2009 Kitamura ..... H05K 7/1421 174/520
7,643,285 B2 * 1/2010 Nishiyama et al. ..... 361/679.49
7,864,527 B1 * 1/2011 Whitted ..... H05K 7/20736 165/104.33
7,889,495 B2 * 2/2011 Tachikawa ..... G06F 1/203 165/104.33
7,914,366 B2 * 3/2011 Miyamoto et al. ..... 454/184
8,051,672 B2 * 11/2011 Mallia ..... H05K 7/20754 165/104.33
8,070,242 B2 * 12/2011 Makabe ..... H05K 5/023 312/223.1
8,072,752 B2 * 12/2011 Wantschik ..... 361/695
8,300,410 B2 * 10/2012 Slessman ..... 361/691
8,422,218 B2 * 4/2013 Fried ..... F28D 15/0266 361/679.47
8,456,840 B1 6/2013 Clidaras et al.
8,616,194 B2 * 12/2013 Sherrow ..... F24H 9/14 126/110 A
8,717,747 B2 * 5/2014 Chen ..... G06F 1/183 312/223.1
8,934,246 B1 * 1/2015 Keig ..... H02M 7/003 361/690
9,459,634 B2 * 10/2016 Erwin ..... G05D 23/19
9,682,436 B2 * 6/2017 d'Amario ..... B23H 1/02
9,696,046 B2 * 7/2017 Stewart ..... F24F 3/0442
9,985,842 B2 * 5/2018 White ..... H04L 41/12
2002/0092313 A1 7/2002 Brifu
2002/0101117 A1 * 8/2002 Shibuya ..... H04B 1/082 307/9.1
2002/0166334 A1 11/2002 Houk et al.
2003/0094010 A1 * 5/2003 Katatani ..... F24F 1/027 62/259.1
2004/0086780 A1 * 5/2004 Ebermann ..... H01M 2/1077 429/120
2005/0016199 A1 1/2005 Blackstone
2005/0081538 A1 * 4/2005 Pleva ..... H01F 6/04 62/93
2005/0086966 A1 4/2005 Bae
2005/0098643 A1 5/2005 Guyer
2005/0124286 A1 6/2005 Goldsmith
2005/0135059 A1 * 6/2005 Araki et al. ..... 361/690
2005/0168929 A1 * 8/2005 Inoue ..... G06F 1/181 361/679.34
2005/0225936 A1 * 10/2005 Day ..... H05K 7/20754 361/679.47
2005/0231915 A1 * 10/2005 Keenan et al. ..... 361/700
2005/0270751 A1 * 12/2005 Coglitore ..... H05K 7/1411 361/724
2006/0087801 A1 * 4/2006 Champion ..... G06F 1/185 361/679.41
2007/0053162 A1 3/2007 Keenan et al.
2007/0095507 A1 * 5/2007 Henderson ..... F28D 15/043 165/104.26
2007/0129000 A1 6/2007 Rasmussen et al.
2007/0213000 A1 * 9/2007 Day ..... 454/184
2007/0257487 A1 11/2007 Jacklich et al.
2007/0279861 A1 * 12/2007 Doll ..... G06F 1/20 361/679.48
2007/0281639 A1 12/2007 Clidaras et al.
2008/0086994 A1 4/2008 Descotes et al.
2008/0160902 A1 7/2008 Desler
2008/0259566 A1 * 10/2008 Fried ..... H05K 7/20809 361/699
2009/0016009 A1 * 1/2009 Barrall ..... G06F 1/187 361/679.31
2009/0056910 A1 3/2009 Mallia et al.
2009/0071746 A1 * 3/2009 Teisseyre ..... F04D 29/669 181/151
2009/0305621 A1 12/2009 Eckardt et al.
2010/0037574 A1 2/2010 Weber et al.
2010/0097752 A1 * 4/2010 Doll ..... G06F 1/20 361/679.48
2010/0139908 A1 6/2010 Slessman
2010/0218919 A1 * 9/2010 Shibata ..... F24F 12/006 165/104.34
2010/0299954 A1 12/2010 Roselle et al.
2010/0301034 A1 12/2010 Greenwood et al.
2010/0311316 A1 * 12/2010 Tindale ..... B01D 46/28 454/184
2011/0056651 A1 3/2011 Monk et al.
2011/0110039 A1 * 5/2011 Feltner ..... H05K 7/20909 361/695
2013/0075056 A1 * 3/2013 Fernandez ..... H04Q 1/025 165/45
2013/0092431 A1 * 4/2013 Jones ..... H05K 7/20145 174/548
2013/0208421 A1 * 8/2013 Chester ..... H05K 7/20772 361/699
2014/0036418 A1 * 2/2014 Eichler ..... H05K 7/1432 361/605
2014/0213172 A1 7/2014 Jameson et al.
2015/0111488 A1 4/2015 Son et al.

(56) References Cited

U.S. PATENT DOCUMENTS

| | | | | |
|---|---|---|---|---|
| 2015/0147952 | A1* | 5/2015 | Pfannenberg | H05K 7/20009 454/184 |
| 2015/0373872 | A1* | 12/2015 | Khandelwal | H05K 7/20572 361/695 |
| 2016/0298869 | A1* | 10/2016 | McKie | F24F 12/001 |
| 2017/0092405 | A1* | 3/2017 | Manahan | H01F 7/064 |

FOREIGN PATENT DOCUMENTS

| | | | |
|---|---|---|---|
| CN | 1690534 | A | 11/2005 |
| CN | 2811822 | Y | 8/2006 |
| CN | 1888585 | A | 1/2007 |
| CN | 1979015 | A | 6/2007 |
| CN | 101440979 | A | 5/2009 |
| CN | 201297715 | Y | 8/2009 |
| CN | 201340028 | Y | 11/2009 |
| KR | 100781267 | B1 | 11/2007 |
| KR | 100851500 | B1 | 8/2008 |
| WO | 9424493 | | 10/1994 |
| WO | 9913273 | A1 | 3/1999 |
| WO | 0150067 | A2 | 7/2001 |
| WO | 2009137215 | A2 | 11/2009 |

OTHER PUBLICATIONS

Stewart, Jeffrey L., et al.; U.S. Appl. No. 12/732,777, filed Mar. 26, 2010; "Modular Air Handling Unit;".
Chinese Office Action; Application No. 201110081227.X; dated Sep. 6, 2013; 9 pages.
Chinese Office Action; Application No. 201110081227.X; dated Mar. 25, 2013; 18 pages.
Office Action dated Apr. 10, 2013; U.S. Appl. No. 12/732,772, filed Mar. 26, 2010; 16 pages.
Office Action dated Mar. 27, 2013; U.S. Appl. No. 12/732,777, filed Mar. 26, 2010; 16 pages.
Canadian Office Action; Application No. 2,733,052; dated Mar. 8, 2013; 2 pages.
Chinese Office Action; Application No. 201110081439.8; dated Feb. 17, 2013; 11 pages.
Canadian Office Action; Application No. 2,733,051; dated Mar. 19, 2013; 2 pages.
Chinese Office Action; Application No. 201110081227.X; dated Jan. 13, 2014; 29 pages.
Chinese Office Action; Application No. 201110081439.8; dated Jul. 3, 2014; 14 pages.
Chinese Office Action; Application No. 201110081439.8; dated Apr. 15, 2014; 38 pages.
Chinese Office Action; Application No. 201110081227.X; dated May 14, 2014; 30 pages.
Final Office Action dated Oct. 25, 2013; U.S. Appl. No. 12/732,772, filed Mar. 26, 2010; 9 pages.
Final Office Action dated Oct. 15, 2013; U.S. Appl. No. 12/732,777, filed Mar. 26, 2010; 23 pages.
Canadian Office Action; Application No. 2,733,052; dated Nov. 15, 2013; 2 pages.
Chinese Office Action; Application No. 201110081439.8; dated Sep. 22, 2013; 11 pages.
Canadian Office Action; Application No. 2,733,051; dated Nov. 15, 2013; 2 pages.
Chinese Office Action; Application No. 201110081227.X; dated Oct. 8, 2014; 7 pages.
Advisory Action dated Feb. 12, 2014; U.S. Appl. No. 12/732,772, filed Mar. 26, 2010; 3 pages.
Office Action dated Oct. 8, 2014; U.S. Appl. No. 12/732,772, filed Mar. 26, 2010; 27 pages.
Advisory Action dated Dec. 31, 2013; U.S. Appl. No. 12/732,777, filed Mar. 26, 2010; 7 pages.
Office Action dated Aug. 8, 2014; U.S. Appl. No. 12/732,777, filed Mar. 26, 2010; 25 pages.
Final Office Action dated Feb. 17, 2015; U.S. Appl. No. 12/732,777, filed Mar. 26, 2010; 19 pages.
Canadian Office Action; Application No. 2,733,052; dated Sep. 5, 2014; 2 pages.
Chinese Office Action; Application No. 201110081439.8; dated Jan. 15, 2015; 10 pages.
Final Office Action dated May 21, 2015; U.S. Appl. No. 12/732,772, filed Mar. 26, 2010; 28 pages.
Advisory Action dated Apr. 24, 2015; U.S. Appl. No. 12/732,777, filed Mar. 26, 2010; 3 pages.
Advisory Action dated May 22, 2015; U.S. Appl. No. 12/732,777, filed Mar. 26, 2010; 4 pages.
Advisory Action dated Aug. 14, 2015; U.S. Appl. No. 12/732,772, filed Mar. 26, 2010; 7 pages.
Office Action dated Jul. 17, 2015; U.S. Appl. No. 12/732,777, filed Mar. 26, 2010; 19 pages.
Final Office Action dated May 19, 2016; U.S. Appl. No. 12/732,772, filed Mar. 26, 2010; 19 pages.
Advisory Action dated Jun. 16, 2016; U.S. Appl. No. 12/732,772, filed Mar. 26, 2010; 3 pages.
Advisory Action dated Jul. 14, 2016; U.S. Appl. No. 12/732,772, filed Mar. 26, 2010; 4 pages.
Final Office Action dated Jul. 5, 2016; U.S. Appl. No. 12/732,777, filed Mar. 26, 2010; 17 pages.
Office Action dated Oct. 11, 2016; U.S. Appl. No. 12/732,772, filed Mar. 26, 2010; 11 pages.
Advisory Action dated Aug. 26, 2016; U.S. Appl. No. 12/732,777, filed Mar. 26, 2010; 3 pages.
Final Office Action dated Feb. 10, 2017; U.S. Appl. No. 12/732,272, filed Mar. 25, 2010; 10 pages.
Indian Office Action; Application No. 277/KOL/2011; dated Dec. 26, 2016; 8 pages.
Indian Office Action; Application No. 276/KOL/2011; dated Jan. 3, 2017; 3 pages.
Notice of Allowance dated May 11, 2017; U.S. Appl. No. 12/732,172, filed Mar. 26, 2010; 14 pages.
Notice of Allowance dated Mar. 29, 2017; U.S. Appl. No. 12/732,377, filed Mar. 26, 2010; 23 pages.
Stewart, Jeffrey L., et al.; U.S. Appl. No. 15/701,156, filed Sep. 11, 2017; "Air Handling Unit With Inner Wall Features"; 23 pages.
Advisory Action dated Oct. 27. 2015; U.S. Appl. No. 12/732,772, filed Mar. 26, 2010; 4 pages.
Office Action dated Jan. 4, 2016; U.S. Appl. No. 12/732,772, filed Mar. 26, 2010; 15 pages.
Final Office Action dated Dec. 17, 2015; U.S. Appl. No. 12/732,777, filed Mar. 26, 2010; 21 pages.
Advisory Action dated Feb. 2, 2016; U.S. Appl. No. 12/732,777, filed Mar. 26, 2010; 3 pages.
Advisory Action dated Mar. 10, 2016; U.S. Appl. No. 12/732,777, filed Mar. 26, 2010; 4 pages.
Office Action dated Apr. 21, 2016; U.S. Appl. No. 12/732,777, filed Mar. 26, 2010; 20 pages.
Office Action dated Apr. 9, 2018; U.S. Appl. No. 15/701,156, filed Sep. 11, 2017; 37 pages.

* cited by examiner

AIR HANDLING UNIT WITH INNER WALL SPACE

CROSS-REFERENCE TO RELATED APPLICATIONS

Not applicable.

STATEMENT REGARDING FEDERALLY SPONSORED RESEARCH OR DEVELOPMENT

Not applicable.

REFERENCE TO A MICROFICHE APPENDIX

Not applicable.

BACKGROUND

Heating, ventilation, and air conditioning systems (HVAC systems) sometimes comprise electronic control boards and/or other control devices.

SUMMARY OF THE DISCLOSURE

In some embodiments, an air handling unit is provided that comprises an interior shell, an exterior skin associated with the interior shell to form a wall space at least partially bound by each of the interior shell and the exterior skin, and a control component at least partially carried within the wall space.

In other embodiments, a cabinet for an air handling unit is provided that comprises at least one wall comprising an interior shell and an exterior skin associated with the interior shell to form a wall space at least partially bound by each of the interior shell and the exterior skin. The at least one wall at least partially defines a fluid duct of the cabinet and a control component is at least partially disposed within the wall space.

BRIEF DESCRIPTION OF THE DRAWINGS

For a more complete understanding of the present disclosure and the advantages thereof, reference is now made to the following brief description, taken in connection with the accompanying drawings and detailed description, wherein like reference numerals represent like parts.

DETAILED DESCRIPTION

Control boards and/or devices of air handling units sometimes exhibit degraded performance when they are exposed to temperature gradients, changes in humidity, air contaminates, and/or other environmental factors. Additionally, control boards and other control devices sometimes fail prematurely in response to such exposures. Still further, while such control boards and/or control devices may be useful in controlling an air handling unit, their existence further increases the overall size and/or space requirement for the air handling units. Accordingly, the present disclosure provides air handling units that protect a variety of control components from environmental factors. In some embodiments among others, the present disclosure provides an air handling unit (AHU) that comprises a double-wall cabinet construction that carries a control component between the walls of the double-wall cabinet. The space between the walls of the double-wall cabinet may comprise insulation that at least partially surrounds a space configured to carry the control component. Further, one or more of the walls of the double-wall cabinet may be formed to provide an enclosure for the control component.

Figure 1:
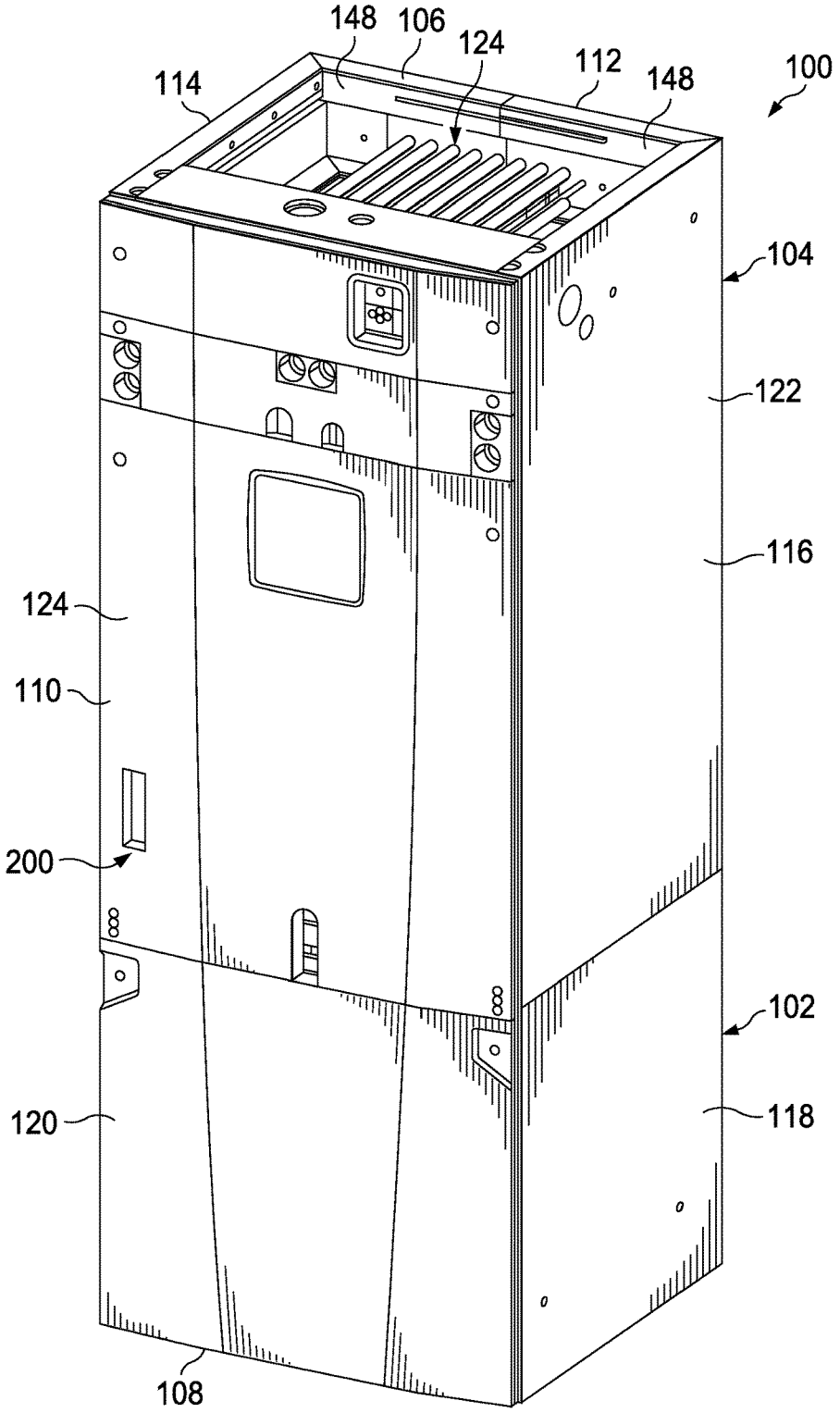
FIG. 1 is an oblique view of an air handling unit according to embodiments of the disclosure.
Figure 2:
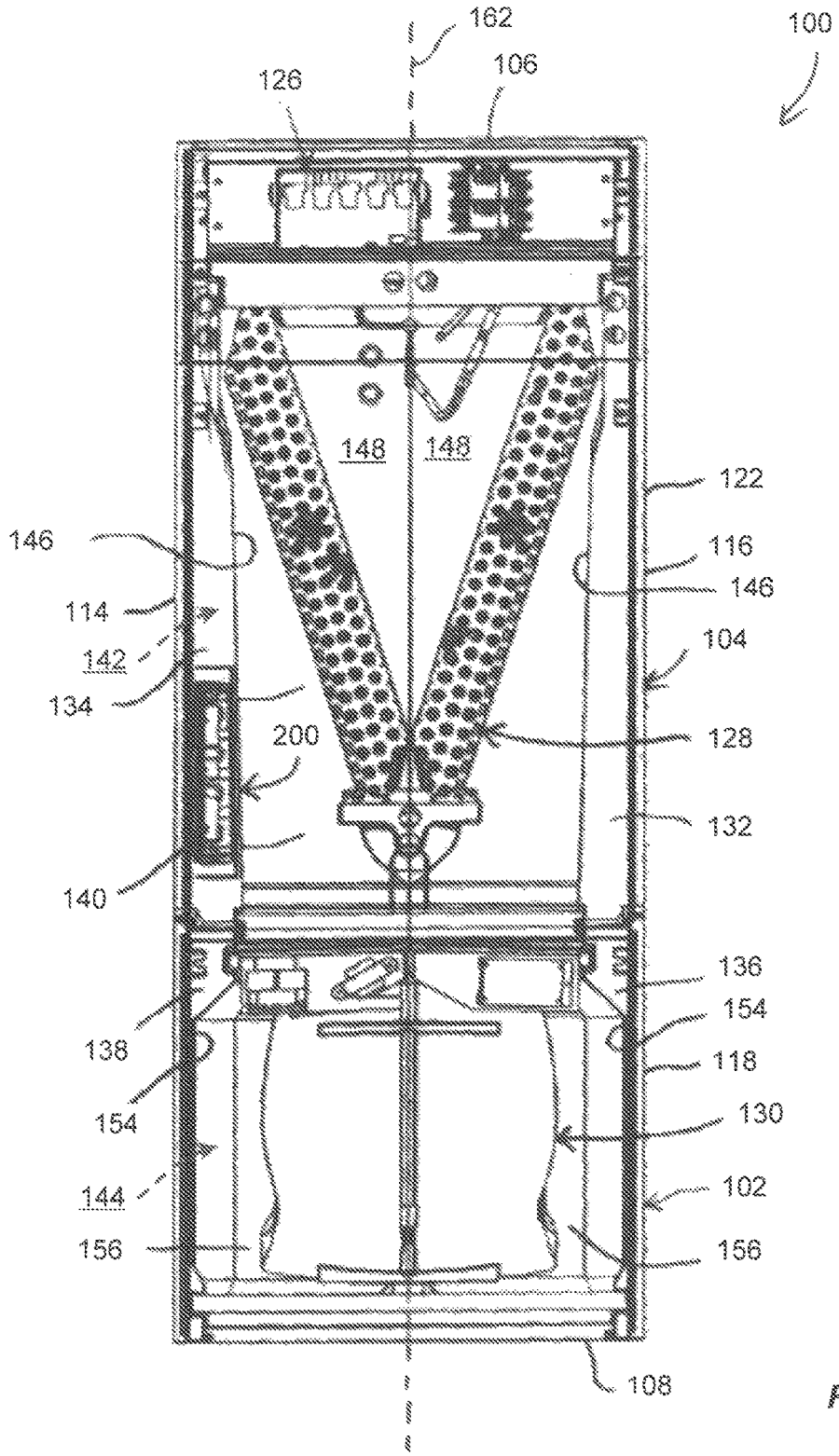
FIG. 2 is an orthogonal view of the front of the air handling unit of FIG. 1 in an assembled configuration.
Figure 3:
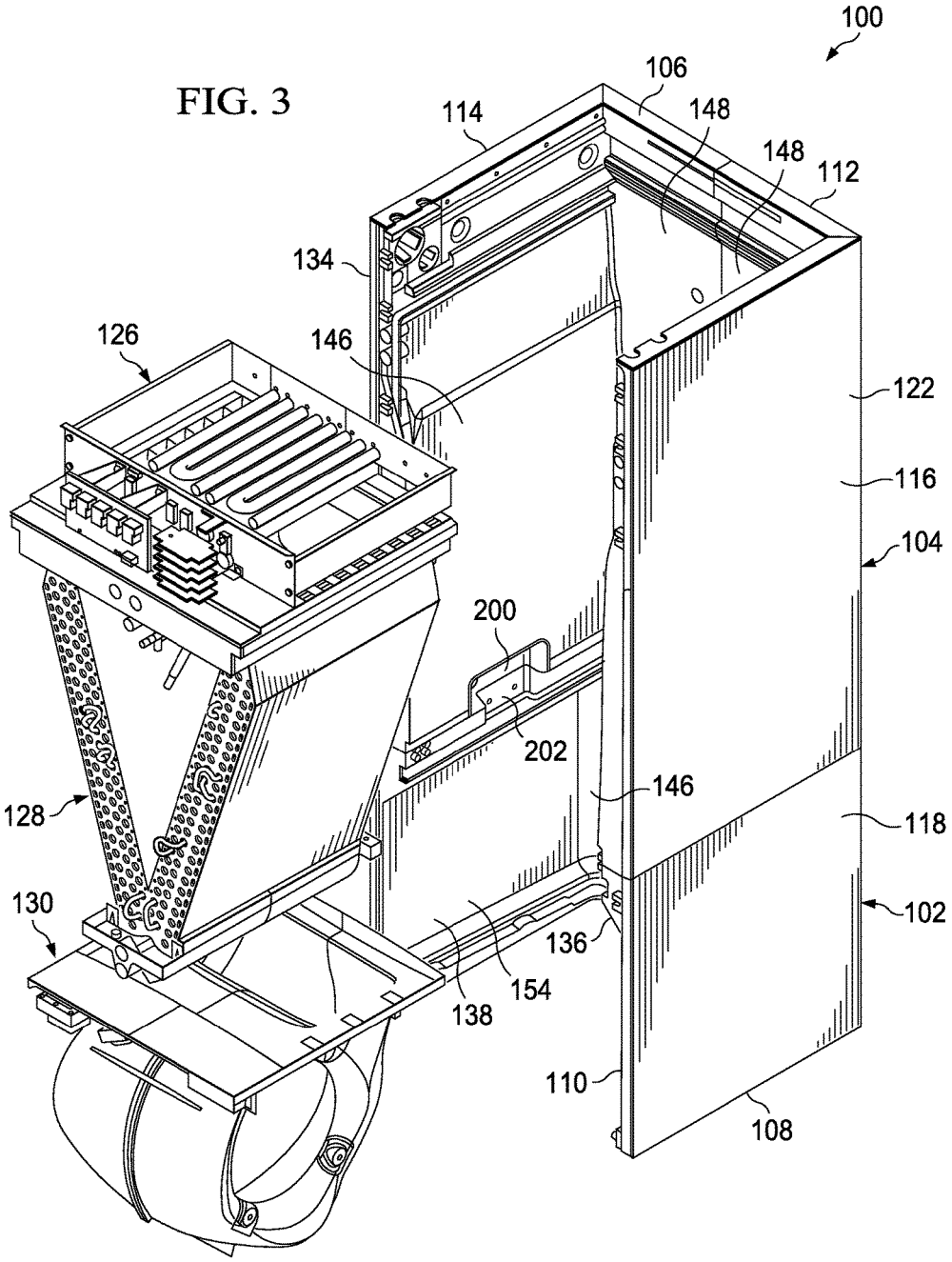
FIG. 3 is a partially exploded oblique view of the air handling unit of FIG. 1.

Referring now to FIGS. 1-3, an AHU 100 according to the disclosure is shown. In this embodiment, AHU 100 comprises a lower blower cabinet 102 attached to an upper heat exchanger cabinet 104. Most generally and for purposes of this discussion, AHU 100 may be described as comprising a top side 106, a bottom side 108, a front side 110, a back side 112, a left side 114, and a right side 116. It will be appreciated that such directional descriptions are meant to assist the reader in understanding the physical orientation of the various components parts of the AHU 100 but that such directional descriptions shall not be interpreted as limitations to the possible installation orientations of an AHU 100. Further, it will be appreciated that the above-listed directional descriptions may be shown and/or labeled in the figures by attachment to various component parts of the AHU 100. It will be appreciated that attachment of directional descriptions at different locations or two different components of AHU 100 shall not be interpreted as indicating absolute locations of directional limits of the AHU 100, but rather, that a plurality of shown and/or labeled directional descriptions in a single Figure shall provide general directional orientation to the reader so that directionality may be easily followed amongst various the Figures. Still further, it will be appreciated that the component parts and/or assemblies of the AHU 100 may be described below as generally having top, bottom, front, back, left, and right sides which should be understood as being consistent in orientation with the top side 106, bottom side 108, front side 110, back side 112, left side 114, and right side 116 of the AHU 100.

Blower cabinet 102 comprises a four-walled fluid duct that accepts fluid (air) in through an open bottom side of the blower cabinet 102 and allows exit of fluid through an open top side of the blower cabinet 102. In this embodiment, the exterior of the blower cabinet 102 comprises a blower cabinet outer skin 118 and a blower cabinet panel 120. It will be appreciated that the blower cabinet panel 120 is removable from the remainder of the blower cabinet 102 thereby allowing access to an interior of the blower cabinet 102. Similarly, heat exchanger cabinet 104 comprises a four-walled fluid duct that accepts fluid (air) from the blower cabinet 102 and passes the fluid from an open bottom side of the heat exchanger cabinet 104 and allows exit of the fluid through an open top side of the heat exchanger cabinet 104. In this embodiment, the exterior of the heat exchanger cabinet 104 comprises a heat exchanger cabinet outer skin 122 and a heat exchanger cabinet panel 124. It will be appreciated that the heat exchanger cabinet panel 124 is removable from the remainder of the heat exchanger cabinet 104 thereby allowing access to an interior of the heat exchanger cabinet 104.

The AHU 100 further comprises a plurality of selectively removable components. More specifically, the AHU 100 comprises a heater assembly 126 and may be removably carried within the heat exchanger cabinet 104. The AHU 100 further comprises a refrigeration coil assembly 128 that may also be removably carried within the heat exchanger cabinet 104. In this embodiment, the heater assembly 126 is configured to be optionally carried within heat exchanger cabinet 104 nearer the top side 106 of the AHU 100 than the refrigeration coil assembly 128. Similarly, the AHU 100 comprises a blower assembly 130 that may be removably carried within the blower cabinet 102. It will be appreciated that the AHU 100 may be considered fully assembled when the blower assembly 130 is carried within the blower cabinet 102, each of the refrigeration coil assembly 128 and the heater assembly 126 are carried within the heat exchanger cabinet 104, and when the blower cabinet panel 120 and heat exchanger cabinet panel 124 are suitably associated with the blower cabinet outer skin 118 and the heat exchanger cabinet outer skin 122, respectively. When the AHU 100 is fully assembled, it will be appreciated that fluid (air) may generally follow a path through the AHU 100 along which the fluid enters through the bottom side 108 of the AHU 100, successively encounters the blower assembly 130, the refrigeration coil assembly 128, and the heater assembly 126, and thereafter exits the AHU 100 through the top side 106 of the AHU 100.

In this embodiment, each of the four walls of the blower cabinet 102 and the heat exchanger cabinet 104 are configured to have a double-wall construction. More specifically, the heat exchanger cabinet 104 further comprises a heat exchanger cabinet right shell 132 and a heat exchanger cabinet left shell 134. In this embodiment, the heat exchanger cabinet right shell 132 and the heat exchanger cabinet left shell 134 may be joined to generally form the interior of the heat exchanger cabinet 104. In order to form the above-mentioned double-wall construction for the heat exchanger cabinet 104, it will be appreciated that the heat exchanger cabinet outer skin 122 generally covers the right side and back side of the heat exchanger cabinet right shell 132 while also generally covering the left side and back side of the heat exchanger cabinet left shell 134. Most generally, the heat exchanger cabinet right shell 132, the heat exchanger cabinet left shell 134, and the heat exchanger cabinet outer skin 122 are shaped so that upon their assembly together a heat exchanger cabinet wall space 142 exists between the heat exchanger cabinet outer skin 122 and each of the heat exchanger cabinet right shell 132 and the heat exchanger cabinet left shell 134. It will be appreciated that the blower cabinet right shell 136, the blower cabinet left shell 138, and the blower cabinet outer skin 118 are also shaped so that upon their assembly together a blower cabinet wall space 144 exists between the blower cabinet outer skin 118 and each of the blower cabinet right shell 136 and the blower cabinet left shell 138.

In some embodiments, one or more of the heat exchanger cabinet wall space 142 and blower cabinet wall space 144 may be at least partially filled with an insulating material. More specifically, in some embodiments, a polyurethane foam may at least partially fill exchanger cabinet wall space 142 and the lower cabinet wall space 144. At least partially filling one or more of the spaces 142, 144 may increase a structural integrity of the AHU 100, may increase a thermal resistance of the AHU 100 between the interior of the AHU 100 and the exterior of the AHU 100, may decrease air leakage from the AHU 100, and may reduce and/or eliminate the introduction of volatile organic compounds (VOCs) into breathing air attributable to the AHU 100. Such a reduction in VOC emission by the AHU 100 may be attributable to the lack of and/or reduced use of traditional fiberglass insulation within the AHU 100 made possible by the insulative properties provided by the polyurethane foam within the spaces 142, 144.

In some embodiments, each of the blower cabinet outer skin 118 and the heat exchanger cabinet outer skin 122 may be constructed of metal and/or plastic. Each of the heat exchanger cabinet right shell 132, the heat exchanger cabinet left shell 134, blower cabinet right shell 136, and blower cabinet left shell 138 may be constructed of a sheet molding compound (SMC). The SMC may be chosen for its ability to meet the primary requirements of equipment and/or safety certification organizations and/or its relatively rigid cleanable surfaces that are resistant to mold growth and compatible with the use of antimicrobial cleaners. Further, the polyurethane foam used to fill the spaces 142, 144 may comprise refrigerant and/or pentane to enhance the thermal insulating characteristics of the foam. Of course, in alternative embodiments, any other suitable material may be used to form the components of the AHU 100.

Further, each of the heat exchanger cabinet right shell 132 and the heat exchanger cabinet left shell 134 comprise an interior side surface 146, an interior rear surface 148, an exterior side surface 150, and an exterior rear surface. Similarly, each of the blower cabinet right shell 136 and the blower cabinet left shell 138 comprise an interior side surface 154, an interior rear surface 156, an exterior side surface, and an exterior rear surface. Most generally, and with a few exceptions, it will be appreciated that each of the pairs of interior side surfaces 146, interior rear surfaces 148, exterior side surfaces 150, exterior rear surfaces, interior side surfaces 154, interior rear surfaces 156, exterior side surfaces, and exterior rear surfaces are substantially mirror images of each other. More specifically, the above listed pairs of surfaces are substantially mirror images of each other about a bisection plane 162 (see FIG. 2) that is generally parallel to both the AHU left side 114 and the AHU right side 116 and which is substantially equidistant from both the AHU left side 114 and the AHU right side 116.

Figure 4:
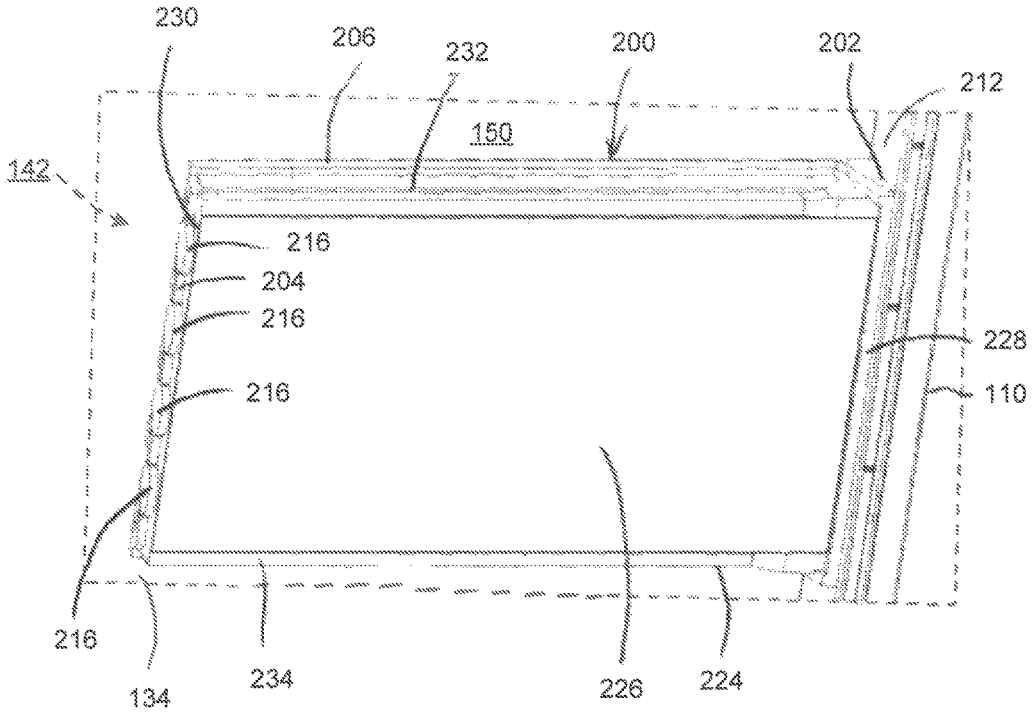
FIG. 4 is an oblique partial left side view of an enclosure of a heat exchanger cabinet left shell of the air handling unit of FIG. 1.
Figure 5:
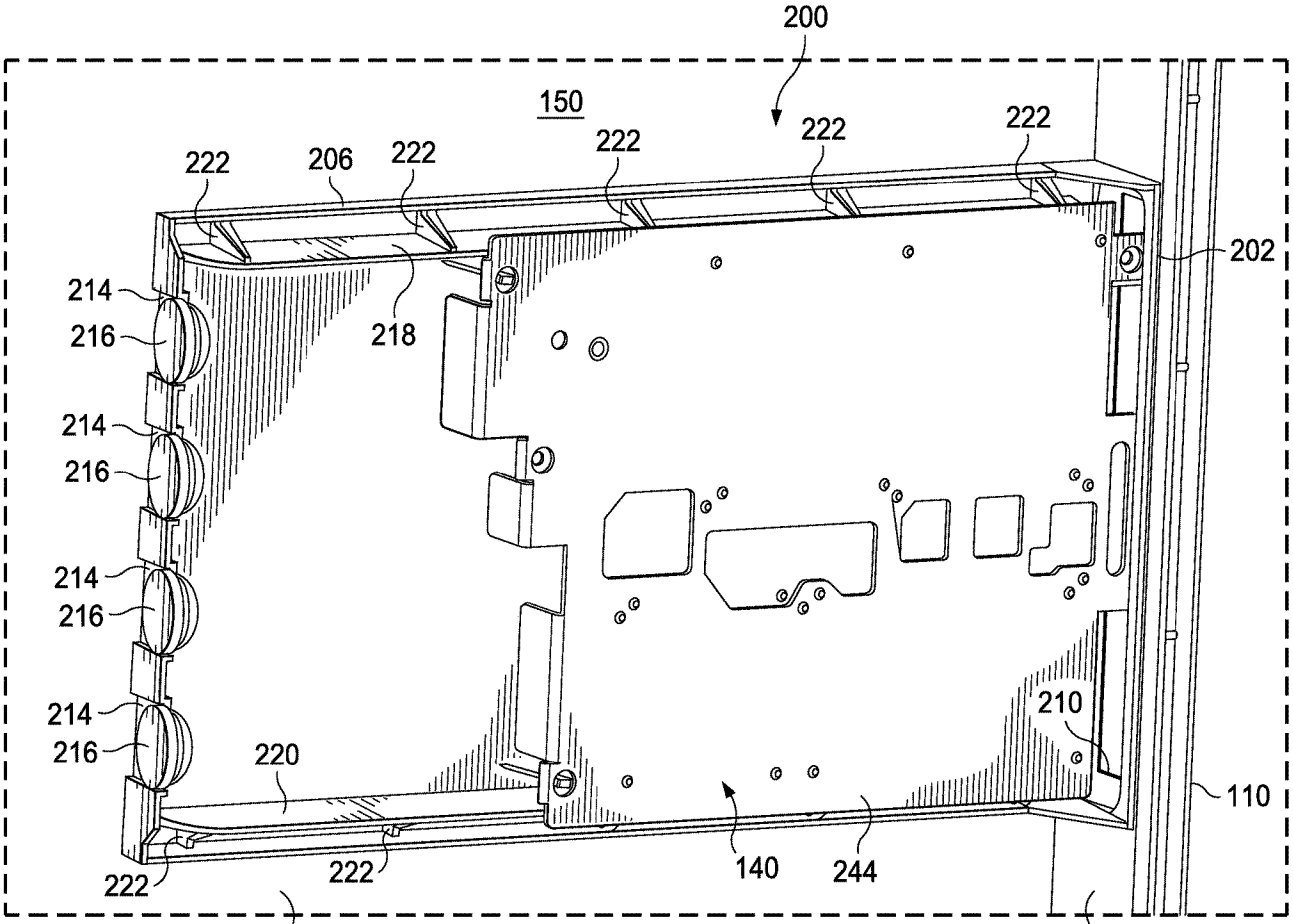
FIG. 5 is an oblique partial left side view of the enclosure of the heat exchanger cabinet left shell of the air handling unit of FIG. 1 with a cover of the enclosure removed.
Figure 6:
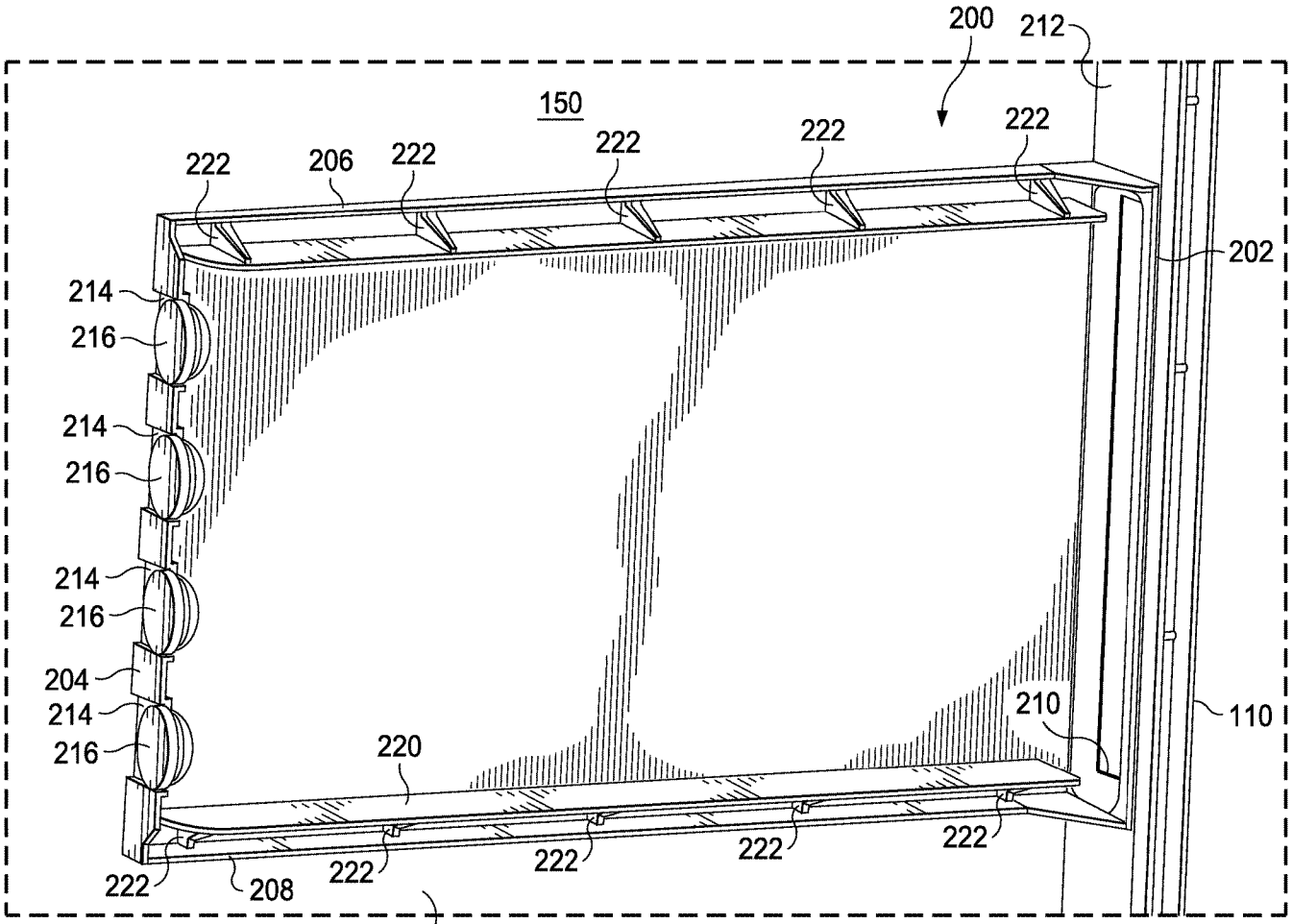
FIG. 6 is an oblique partial left side view of the enclosure of the heat exchanger cabinet left shell of the air handling unit of FIG. 1 with a cover of the enclosure and a control board removed.
Figure 7:
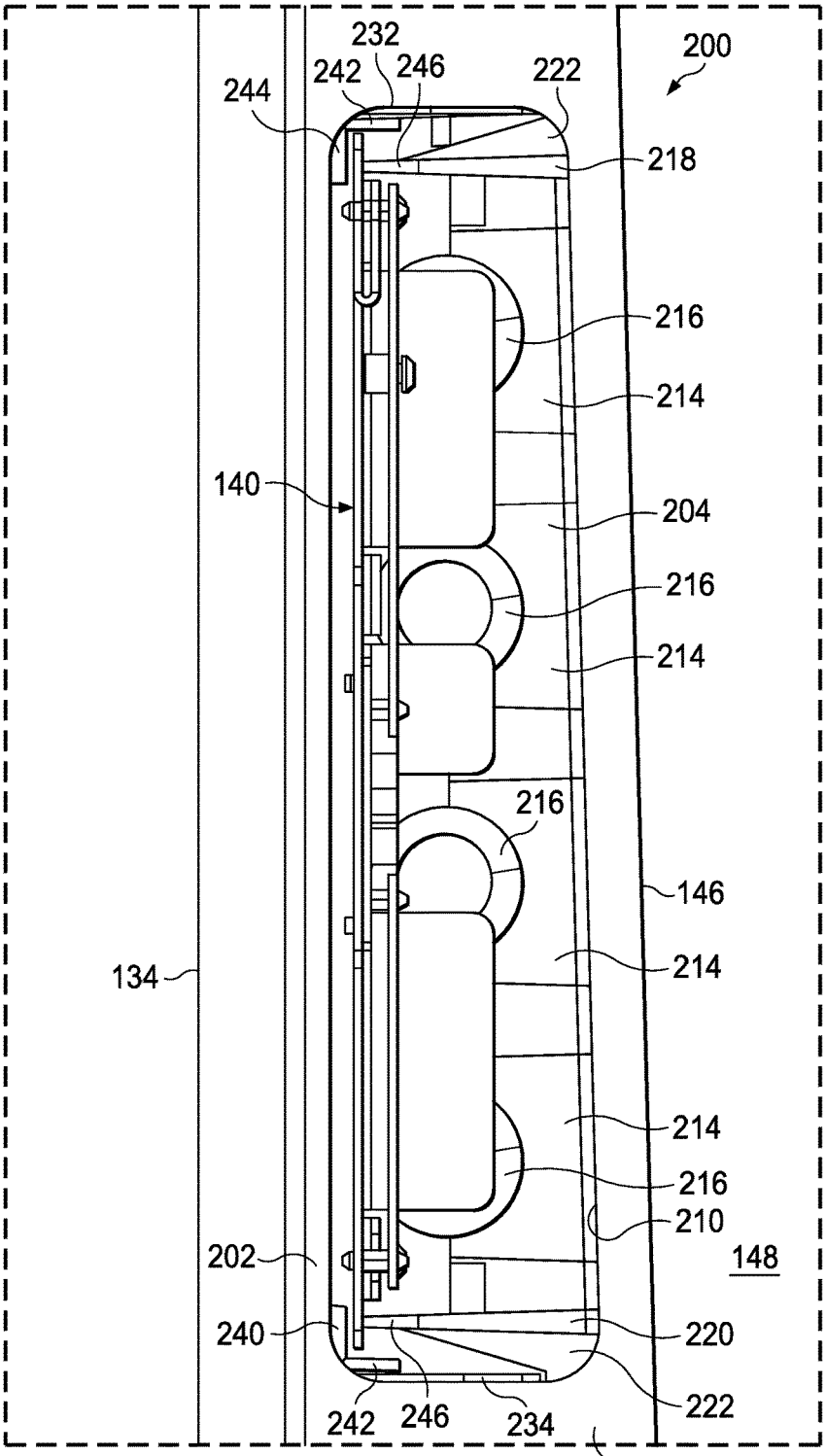
FIG. 7 is a partial front view of the air handling unit of FIG. 1.
Figure 8:
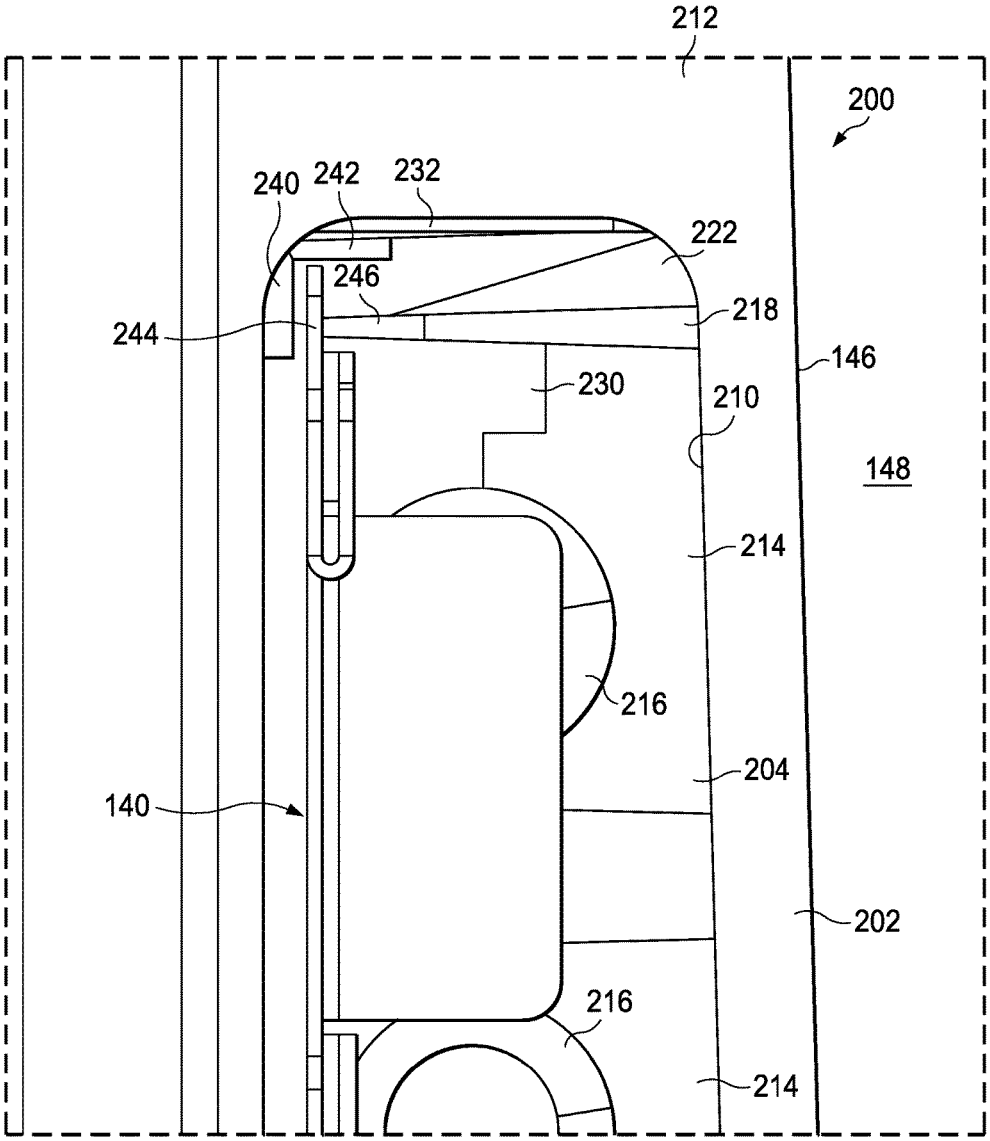
FIG. 8 is another partial front view of the air handling unit of FIG. 1 with a control board removed.
Figure 9:
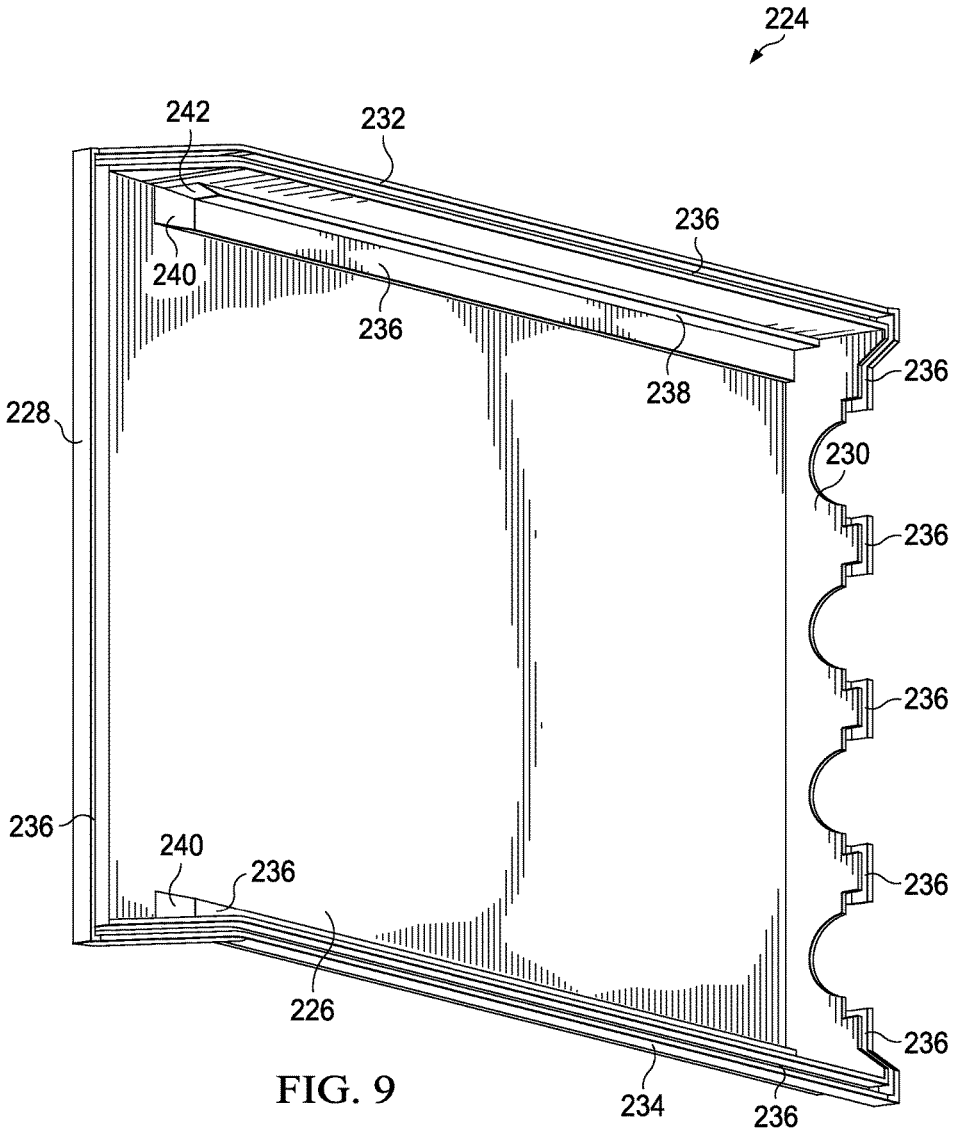
FIG. 9 is an oblique right side view of a cover of the enclosure of FIG. 4.

Referring now to FIGS. 4-9, various views of an enclosure 200 configured to receive the control assembly 140 are shown. FIG. 4 shows a fully assembled enclosure 200, FIG. 5 shows a partially disassembled enclosure 200 with a control assembly 140 installed therein, and FIG. 6 shows the partially disassembled enclosure 200 without a control assembly 140 installed therein. FIGS. 7 and 8 are front views of the enclosure 200 with a control assembly 140 installed therein. FIG. 9 shows a cover 224 of the enclosure. In this embodiment, some portions of the enclosure 200 are integrally formed with heat exchanger cabinet left shell 134. The enclosure 200 generally comprises four walls integrally formed with and extending from the exterior side surface 150 of the heat exchanger cabinet left shell 134. More specifically, a front wall 202, a rear wall 204, an upper wall 206, and a lower wall 208 extend from the exterior side surface 150 of the heat exchanger cabinet left shell 134 to partially bound an interior space of the enclosure 200.

Front wall 202 comprises an aperture 210 for receiving control components such as control assembly 140 therethrough, thereby providing a passage for insertion and removal of control components into and out of the interior space of enclosure 200. In this embodiment, front wall 202 is formed integrally with a larger front flange 212 of heat exchanger cabinet left shell 134. In this embodiment, front flange 212 extends beyond the front wall 202 in both upward and downward directions and extends substantially orthogonally away from exterior side surface 150. In this embodiment, rear wall 204 comprises a plurality of offset recessed sections 214 that each comprise a substantially round edge that is complementary to the shape of grommets 216 in a manner that allows grommets 216 to be removably attached thereto to form a substantially watertight seal. Of course, in alternative embodiments, the sizes and shapes of the front wall 202, rear wall 204, upper wall 206, and the lower wall 208 may be different so long as their configuration serves to at least partially bound the interior space of the enclosure 200.

In addition to the walls 202, 204, 206, and 208, an upper shelf 218 and a lower shelf 220 extend from the exterior side surface 150. In this embodiment, the shelves 218 and 220 are substantially plate-like protrusions that are substantially parallel to each other. The shelves 218, 220 extend generally from near the aperture 210 to near the rear wall 204. The upper shelf 218 is substantially parallel to the upper wall 206 and is offset toward the interior space of the enclosure 200 from the upper wall 206. Similarly, the lower shelf 220 is substantially parallel to the lower wall 208 and is offset toward the interior space of the enclosure 200 from the lower wall 204. In this embodiment, each of the shelves 218, 220 are structurally bolstered by a plurality of support webs 222. A plurality of the support webs 222 extend between the exterior side surface 150 and the upper surface of the upper shelf 218 but do not extend in an upward direction beyond a lower surface of the upper wall 206. Similarly, a plurality of the support webs 222 extend between the exterior side surface 150 and the lower surface of the lower shelf 220 but do not extend in a downward direction beyond an upper surface of the lower wall 208. In this embodiment, the support webs 222 comprise a substantially triangular cross-sectional shape.

In this embodiment, the interior space of the enclosure 200 is further at least partially defined by an enclosure cover 224. Cover 224 generally comprises a substantially plate-like outer panel 226 that, in this embodiment, forms a leftward outer boundary of the enclosure 200 when the cover 224 is installed. The cover 224 is generally configured to complement the shapes and relative layout of the walls 202, 204, 206, 208. In this embodiment, the cover 224 is configured to comprise a front wall 228, a rear wall 230, an upper wall 232, and a lower wall 234. Each of the walls 228, 230, 232, 234 at least partially comprise a double-wall construction that provides receiving slots 236 between the respective two walls of each wall 228, 230, 232, 234. It will be appreciated that slots 236 are sized and otherwise configured to accept portions of walls 202, 204, 206, and 208, respectively, when the cover 224 is installed. The cover 224 further comprises lateral ramps 236 and vertical ramps 238 for guiding a control component such as control assembly 140 into position within the interior space of the enclosure 200. Lateral ramps 236 generally extend inward toward the interior space of the enclosure 200 from the outer panel 226 and are generally located near the intersection of the outer panel 226 and the upper wall 232. Vertical ramps 238 generally extend inward toward the interior space of the enclosure 200 from the upper wall 232 and are generally located near the intersection of the upper wall 232 and the outer panel 226. Each of the ramps 236, 238 extend generally from near the front wall 228 to near the rear wall 230. Each of the ramps 236, 238 further comprise inclines 240, 242 at the front end of the ramps 236, 238, respectively.

Referring now to FIGS. 4 and 7-9, it will be appreciated that cover 224 may be assembled to the walls 202, 204, 206, 208 of the heat exchanger cabinet left shell 134 to, but for the opening presented by aperture 210, substantially bound and/or enclose the interior space of the enclosure 200. In this embodiment, the control assembly 140 comprises a substantially planar carrier 244. The carrier 244 comprises a thickness that allows insertion of the carrier 244 into the interior space of the enclosure 200 while being at least partially bound and/or restricted from movement due to the relative locations of the upper shelf 218, the uppermost located lateral ramp 236, and the uppermost located vertical ramp 238. Similarly, the carrier 244 may be at least partially bound and/or restricted from movement due to the relative locations of the lower shelf 220, the lowermost located lateral ramp 236, and the lowermost located vertical ramp 238. Further, it will be appreciated that the lateral inclines 240, vertical inclines 242, and rounded front corners 246 of the upper and lower shelves 218, 220 may assist in properly aligning the carrier 244 as the carrier 244 is inserted into the interior space of the enclosure 200.

It will be appreciated that, most generally, the exteriors of the walls 202, 204, 206, 208, 228, 230, 232, 234 and panel 226 may delimit one or more boundaries between the enclosure 200 and the remainder of the heat exchanger cabinet wall space 142. Accordingly, the enclosure 200 may be at least partially encapsulated within the above mentioned insulation (i.e., polyurethane foam) so that the enclosure 200 generally forms a pocket of space well suited for receiving control components. It will be appreciated that due to the encapsulation of the enclosure 200 within insulation, the interior space of the enclosure 200 may provide a relatively protective environment for control components carried therein. Specifically, to the extent that insulation surrounds the enclosure 200, the interior space of the enclosure 200 may protect control components from undesirable temperature gradients, airborne contaminants, and/or humidity. The enclosure 200 may further reduce the magnitude of vibrations the control components may experience due to operation of the AHU 100. Still further, due to the location of the enclosure 200 within the double-wall construction of the heat exchanger cabinet 104, the overall size of the AHU 100 may be relatively smaller than if the AHU 100 were to be configured to accommodate the control components within the interior of the AHU 100.

While the above described embodiments disclose placement of the enclosure 200 in association with the heat exchanger cabinet left shell 134, it will be appreciated that one or more enclosures substantially similar to enclosure 200 may be placed in association with any of the other components of the AHU 100 that contribute to a similar double-wall construction.

Still further, it will be appreciated that while significant details of the structure of the enclosure 200 have been disclosed, alternative embodiments of an enclosure for control components may comprise a simpler construction. For example, in some embodiments, control components may be permanently embedded within the polyurethane foam (or other insulation) and may offer more restrictive access to the control components after such embedding. Further, it will be appreciated that in alternative embodiments, insulation may be located within the interior space of the enclosure 200. Without limitation, this disclosure contemplates placement of control components within the wall space (i.e., wall space 142, 144) of any double-wall of an AHU. Further, this disclosure contemplates placement of insulation (i.e., polyurethane foam) in varying amounts and locations both within and to the exterior of an enclosure within such above-described double-wall. Still further, in alternative embodiments, one or more portions of an enclosure may be formed integrally with one or more shells and/or exterior skins.

Figure 10:
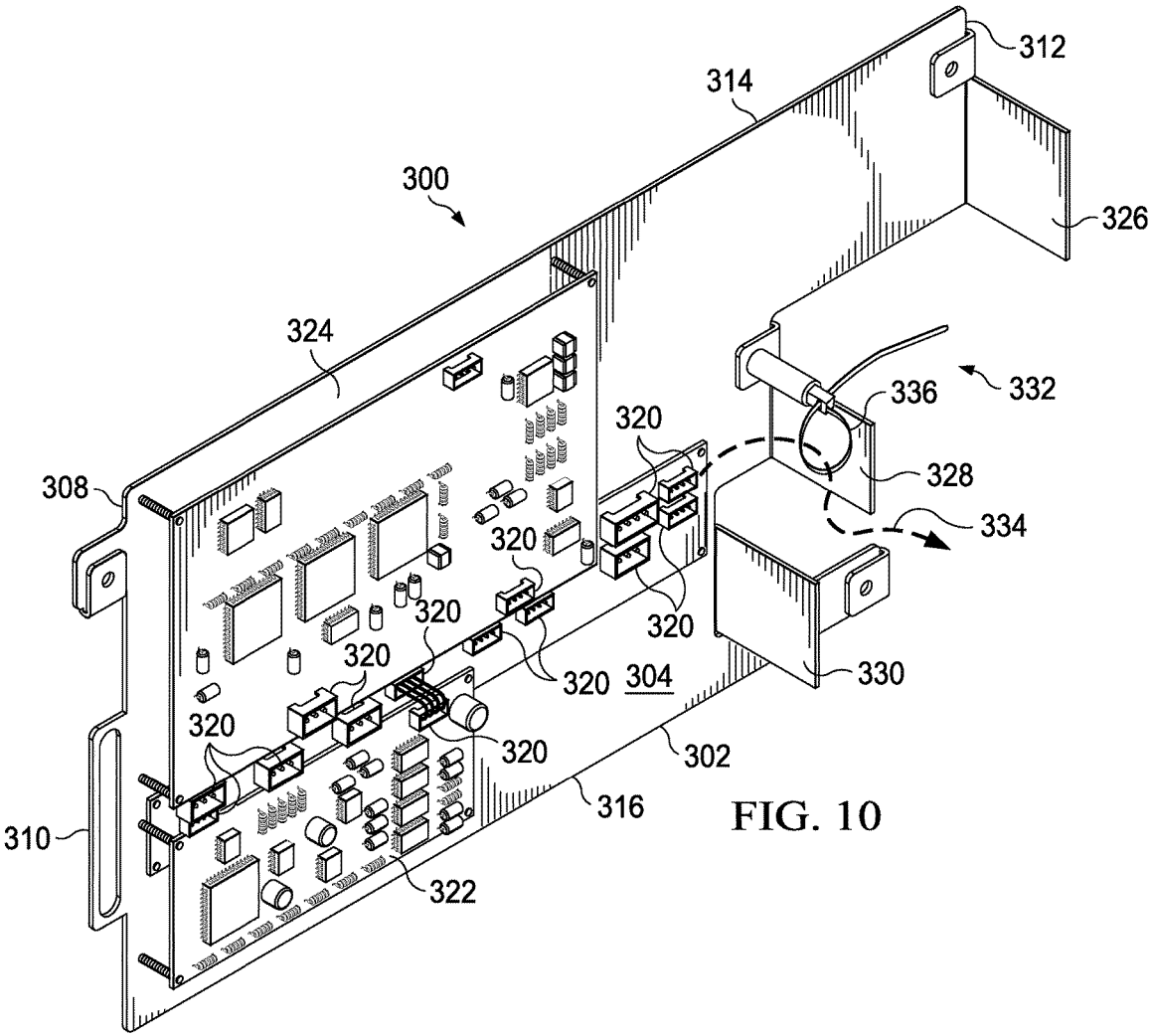
FIG. 10 is an oblique right side view of another embodiment of a control assembly.
Figure 11:
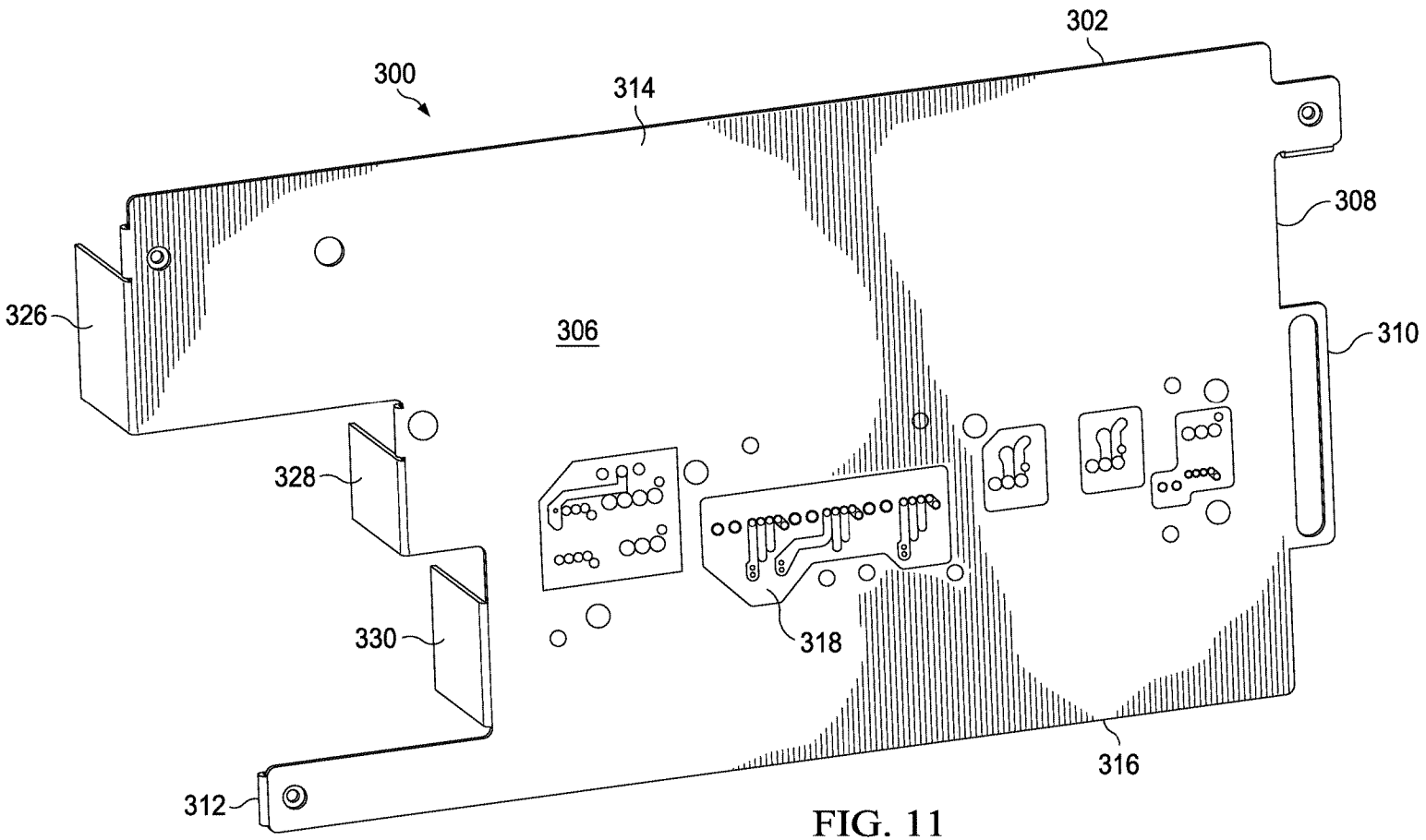
FIG. 11 is an oblique left side view of the control assembly of FIG. 10.

Referring to FIG. 10, an alternative embodiment of a control assembly 300 is shown. Control assembly 300 generally comprises a metallic plate-like control board carrier 302 that may be slidably received within an enclosure such as enclosure 200 of FIGS. 1, 2, and 4-8. The carrier 302 comprises a mounting side 304, a back side 306, a front end 308 comprising a handle 310, a rear end 312, an upper side 314, and a lower side 316. The carrier 302 is configured to be selectively slidably insertable and removable from the enclosure 200.

In this embodiment, the carrier 302 is configured to carry a plurality of control boards and/or control busses. More specifically, the carrier 302 carries a generally centrally located interface board 318. The interface board 318 comprises a plurality of electrical connector receptacles 320 that provide easy interfacing between the interface board 318 and additional selectively associated control boards. The interface board 318 may be configured as a central communication throughput between the other control boards carried by the carrier 302 and the remainder of the control components of an AHU 100. For example, the interface board 318 may be configured to provide communications via a 485 buss and/or a proprietary buss such as Trane's CLII buss. In this embodiment, the interface board 318 is mounted to the carrier 302 via a plurality of electrically conductive fasteners (i.e., eyelets and/or rivets) that electrically connects a ground plane of the interface board 318 to the metallic carrier 302.

The control assembly 300 further comprises an electronic expansion valve control board, referred to as an EEV board 322, and an air handler control board, referred to as an AH board 324. In this embodiment, each of the EEV board 322 and the AH board 324 are mounted to the carrier 302 and/or to the interface board 318 via electrically conductive fasteners. Use of such electrically conductive fasteners further joins a ground plane of the EEV board 322 and a ground plane of the AH board 324 to the metallic carrier 302. As such, it will be appreciated that the ground planes of each of the interface board 318, the EEV board 322, and the AH board 324 are commonly electrically connected to the metallic carrier 302. Sharing the metallic carrier 302 as a common ground plane may provide a reference for shunting of high-frequency signals for reducing electromagnetic interference. It will be appreciated that although the carrier 302 and the components carried by the carrier 302 may be substantially housed within the nonconductive enclosure 200, the metallic carrier 302 may be further electrically connected to a remote ground plane associated with additional communication components of an AHU 100. Such further connection to a shared ground plane with the remainder of the communication components of the AHU 100 may provide improved consistency for electrical references and may result in improved performance of high speed data communication.

The carrier 302 further comprises a rear tab 326 extending orthogonally from the mounting side 304. In this embodiment, the rear tab 326 may be configured to serve as a stop that interferes with a back portion of the enclosure 200 when the carrier 302 is being inserted into the enclosure 200. The carrier 310 further comprises an intermediate tab 328 and a forward tab 330. The intermediate tab 328 and the forward tab 330 each extend substantially orthogonally from the mounting side 304. As shown in FIG. 10, the intermediate tab 328 and the forward tab 330 may partially bound a wire/harness space 332 that is sized sufficiently to house a bundle and/or aggregation of lengthwise cables and/or electrical conductors when the carrier 302 is fully inserted into the enclosure 200. The rear tab 326 may be substantially adjacent and/or abutted against a rear structure of the enclosure 200 such as rear wall 204 when the carrier 302 is fully inserted into the enclosure 200. A forward portion of the lengthwise cables and/or electrical conductors may pass along a cable route 334 that is represented in FIG. 10 is a double-ended arrow meandering from one end in the space 332 to the other end in the space forward of the forward tab 330. In this embodiment, the cable route 334 passes through a standoff mounted wire tie 336. It will be appreciated that provision of the various physical configurations of the carrier 302 may allow a long length of cables and/or electrical conductors to remain connected to at least one of the interface board 318, the EEV board 322, and the AH board 324 while the carrier 302 is fully removed from, partially inserted into, and/or fully inserted into the enclosure 200. Further, the control assembly 300 is provided a reduction in overall height by the shown overlapping of the EEV board 322 and the AH board 324 with the interface board 318.

Figure 12:
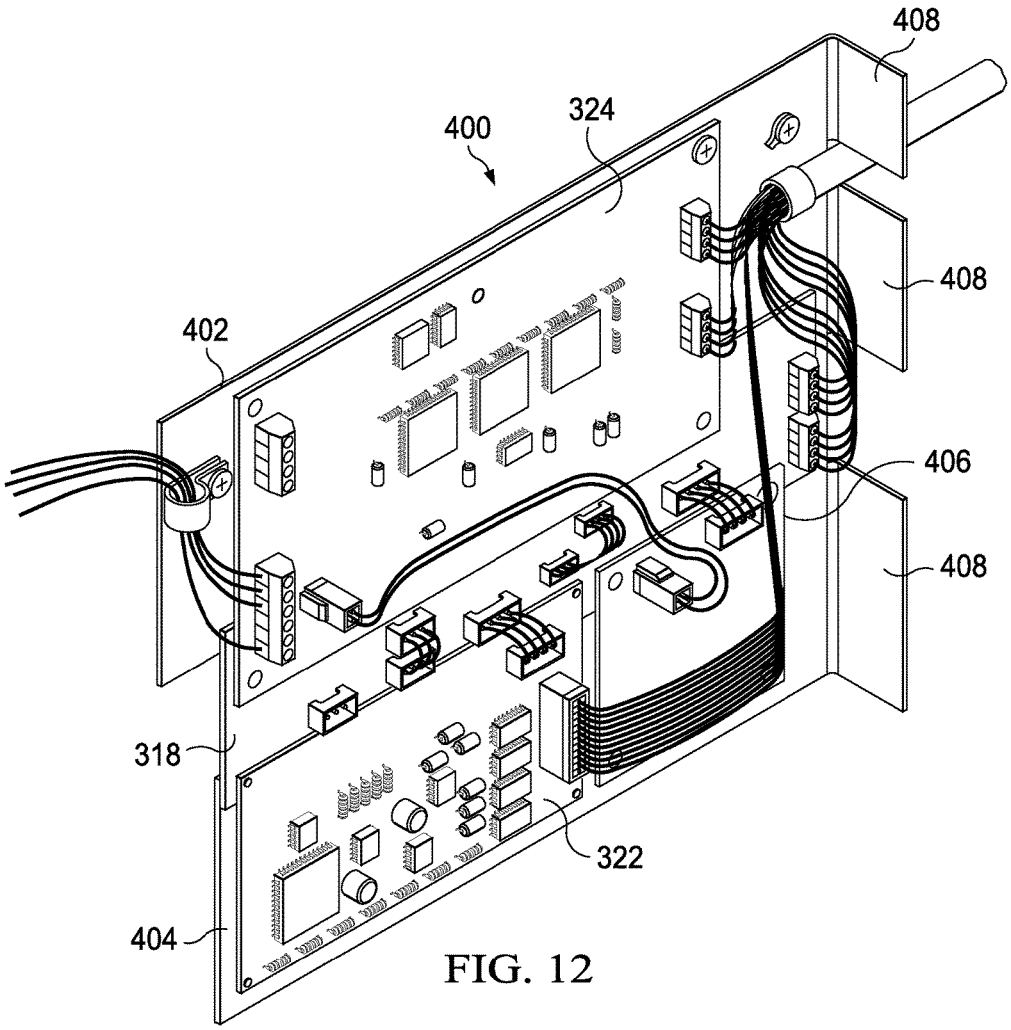
FIG. 12 is an oblique right side view of still another embodiment of a control assembly.

Referring now to FIG. 12, an alternative embodiment of a control assembly 400 is shown. Control assembly 400 comprises some components substantially similar to control assembly 300 but with one primary difference being that rather than comprising a single monolithic carrier 302, the control assembly 400 comprises an upper metal sheet 402 and a lower metal sheet 404 joined together using the interface board 318 as an intermediary for connecting the upper metal sheet 402 to the lower metal sheet 404. The control assembly 400 further comprises a field accessory board 406 that may be electrically connected to the interface board 318. Another difference between the control assembly 400 and control assembly 300 is that the control assembly 400 comprises multiple rear tabs 408. In this embodiment, excess cables and/or electrical conductors may be retained between the rear wall 204 and back sides of the multiple rear tabs 408.

Figure 13:
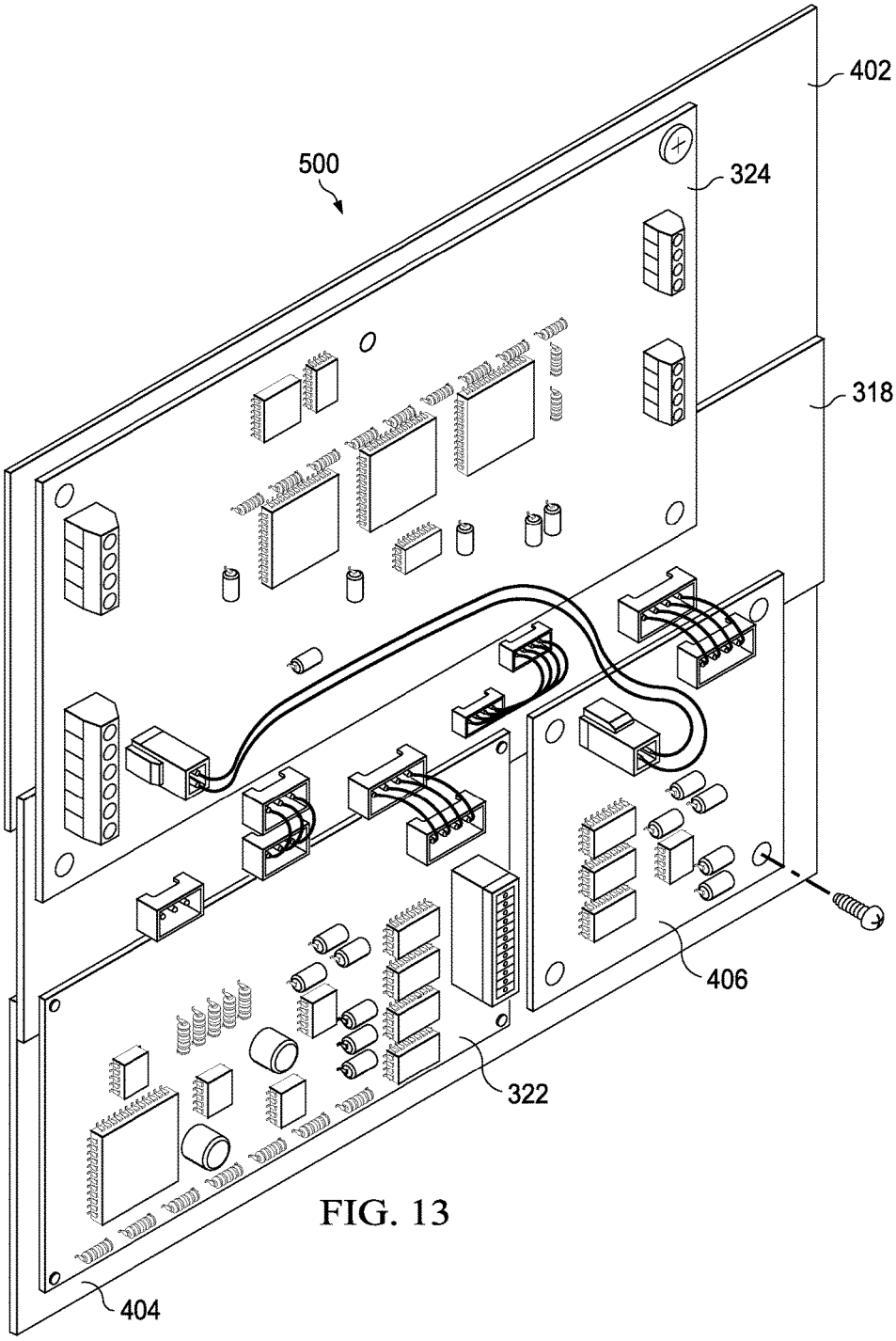
FIG. 13 is an oblique right side view of yet another embodiment of a control assembly.

Referring now to FIG. 13, another alternative embodiment of a control assembly 500 is shown.

While the various control assemblies 140, 300, 400, and 500 comprise differing features, any of the control assemblies 140, 300, 400, and 500 may be selectively and removably received within an enclosure 200, may provide a common improved electrical reference, and may provide a reduction in electromagnetic interference. Further, any one of the components of the control assemblies 140, 300, 400, and 500 which interact with the enclosure 200 may be provided with detents and/or other location and/or interference fit references that provide improved so-called blind access and improved location of the control assemblies 140, 300, 400, and 500 within the enclosure 200.

At least one embodiment is disclosed and variations, combinations, and/or modifications of the embodiment(s) and/or features of the embodiments) made by a person having ordinary skill in the art are within the scope of the disclosure. Alternative embodiments that result from combining, integrating, and/or omitting features of the embodiment(s) are also within the scope of the disclosure. Where numerical ranges or limitations are expressly stated, such express ranges or limitations should be understood to include iterative ranges or limitations of like magnitude falling within the expressly stated ranges or limitations (e.g., from about 1 to about 10 includes, 2, 3, 4, etc.; greater than 0.10 includes 0.11, 0.12, 0.13, etc.). For example, whenever a numerical range with a lower limit, Rl, and an upper limit, Ru, is disclosed, any number falling within the range is specifically disclosed. In particular, the following numbers within the range are specifically disclosed: R=Rl+k*(Ru−Rl), wherein k is a variable ranging from 1 percent to 100 percent with a 1 percent increment, i.e., k is 1 percent, 2 percent, 3 percent, 4 percent, 5 percent, . . . 50 percent, 51 percent, 52 percent, . . . , 95 percent, 96 percent, 97 percent, 98 percent, 99 percent, or 100 percent. Moreover, any numerical range defined by two R numbers as defined in the above is also specifically disclosed. Use of the term "optionally" with respect to any element of a claim means that the element is required, or alternatively, the element is not required, both alternatives being within the scope of the claim. Use of broader terms such as comprises, includes, and having should be understood to provide support for narrower terms such as consisting of, consisting essentially of, and comprised substantially of. Accordingly, the scope of protection is not limited by the description set out above but is defined by the claims that follow, that scope including all equivalents of the subject matter of the claims. Each and every claim is incorporated as further disclosure into the specification and the claims are embodiment(s) of the present invention.

What is claimed is:

1. An air handling unit comprising:

a heat exchanger cabinet comprising:

an interior shell;

an outer skin associated with the interior shell to form a wall space at least partially bound by each of the interior shell and the outer skin; and an enclosure disposed within the wall space, the enclosure including a front wall, a rear wall, an upper wall, a lower wall, an exterior side surface of the interior shell, and a cover, wherein each of the front wall, the rear wall, the upper wall, and the lower wall extend from the exterior side surface of the interior shell into the wall space to at least partially define an enclosure interior space;

wherein the cover is configured for attachment to the each of the front wall, the rear wall, the upper wall, and the lower wall to define an outer boundary of the enclosure interior space between the interior shell and the outer skin;

wherein the front wall is integral with the outer skin and defines an aperture for selective insertion and removal of a control component within the enclosure interior space while the cover remains disposed within the wall space; and wherein insulation is disposed within the wall space to partially encapsulate the enclosure to form a pocket of space suitable for the selective insertion and removal of the control component through the aperture of the front wall while the cover remains disposed within the wall space.

2. The air handling unit of claim 1, wherein the insulation is a polyurethane foam.

3. The air handling unit of claim 1, wherein the control component comprises an electronic control board.

4. The air handling unit of claim 1, wherein at least one of the front wall, the rear wall, the upper wall, and the lower wall is integral with the interior shell.

5. The air handling unit of claim 1, wherein the insulation substantially surrounds the cover and at least one of the front wall, the rear wall, the upper wall, and the lower wall.

6. The air handling unit of claim 1, wherein the control component is bound by a ramp of the cover and at least one of the front wall, the rear wall, the upper wall, and the lower wall.

7. The air handling unit of claim 6, wherein the ramp and at least one of the front wall, the rear wall, the upper wall, and the lower wall is configured to increasingly constrain the control component as the control component is inserted into the enclosure interior space.

8. A air handling unit comprising:

a heat exchanger cabinet comprising:

at least one wall including an interior shell and an outer skin associated with the interior shell to form a wall space at least partially bound by each of the interior shell and the outer skin; and an enclosure disposed within the wall space, the enclosure including a front wall, a rear wall, an upper wall, a lower wall, an exterior side surface of the interior shell, and a cover that at least partially defines an enclosure interior space;

wherein the cover is configured for attachment to the each of the front wall, the rear wall, the upper wall, and the lower wall to define an outer boundary of the enclosure interior space between the interior shell and the outer skin;

wherein the interior shell of the at least one wall at least partially defines a fluid duct of the heat exchanger cabinet;

wherein the front wall is integral with the outer skin and defines an aperture for selective insertion and removal of a control component within the enclosure interior space while the cover remains disposed within the wall space; and wherein insulation is disposed within the wall space to partially encapsulate the enclosure to form a pocket of space suitable for the selective insertion and removal of the control component through the aperture of the front wall while the cover remains disposed within the wall space.

9. The air handling unit according to claim 8, wherein a blower assembly is disposed within the fluid duct.

10. The air handling unit according to claim 8, wherein a heater assembly is disposed within the fluid duct.

11. The air handling unit according to claim 8, wherein a refrigeration coil assembly is disposed within the fluid duct.

12. The air handling unit of claim 8, wherein the insulation substantially surrounds the cover and at least one of the front wall, the rear wall, the upper wall, and the lower wall.

* * * * *